United States Patent [19]

Kufner et al.

[11] Patent Number: 5,075,151

[45] Date of Patent: Dec. 24, 1991

[54] FULLY SYNTHETIC HOT SEALABLE SHIRT LINING

[75] Inventors: Georg Kufner, Grosshesselohe; Josef Kufner, Pullach; Günter Schulz, Holzkirchen; Rainer Weckmann, Unterhaching, all of Fed. Rep. of Germany

[73] Assignee: Kufner Textilwerke GmbH, Munich, Fed. Rep. of Germany

[21] Appl. No.: 562,227

[22] Filed: Aug. 3, 1990

[30] Foreign Application Priority Data

Aug. 4, 1989 [DE] Fed. Rep. of Germany ..... 3925893

[51] Int. Cl.[5] ..... B32B 27/14

[52] U.S. Cl. ..... 428/198; 428/195; 428/196; 428/257; 428/258; 428/259; 428/229

[58] Field of Search ..... 428/257, 258, 259, 198, 428/402, 195, 347, 196, 229

[56] References Cited

U.S. PATENT DOCUMENTS

| | | | |
|---|---|---|---|
| 4,118,529 | 10/1978 | Nakagawa et al. | 428/257 |
| 4,183,978 | 1/1980 | Hefele | 427/202 |
| 4,303,724 | 12/1981 | Sergeant et al. | 428/257 |
| 4,450,196 | 5/1984 | Homat | 428/257 |
| 4,634,625 | 1/1987 | Franklin | 428/257 |
| 4,719,144 | 1/1988 | Homat | 428/257 |
| 4,737,396 | 4/1988 | Homat | 428/257 |
| 4,833,006 | 5/1989 | McHunney et al. | 428/257 |
| 4,839,220 | 6/1989 | Styntjies et al. | 428/257 |

FOREIGN PATENT DOCUMENTS

| | | |
|---|---|---|
| 229817 | 10/1963 | Austria . |
| 328391 | 3/1976 | Austria . |
| 332823 | 10/1976 | Austria . |
| 3419867 | 9/1985 | Fed. Rep. of Germany . |

OTHER PUBLICATIONS

Stukenbrock, *Berkeligung und Wasche,* 3, 142–152 (1968).

*Primary Examiner*—James J. Bell

*Attorney, Agent, or Firm*—Scully, Scott, Murphy & Presser

[57] ABSTRACT

A woven fabric used as a lining in a shirt sector, consisting of fabric-forming warp and weft filaments which consist of synthetic material, wherein the weft yarn consists at least partially of crimped yarns. The finished fabric is then coated in punctiform manner with a hot sealable adhesive on the basis of copolyesters and/or low pressure polyethylene in the spot raster with a spot density of 600 to 1400 spots/inch$^2$. The invention also comprises colored, marked and flame-resistant linings.

The coating with hot sealable adhesive can be carried out in punctiform manner using all the known application technologies. It is also taken into consideration that a calendering process can be undertaken after the coating process.

10 Claims, 1 Drawing Sheet

FULLY SYNTHETIC HOT SEALABLE SHIRT LINING

Figure 1:
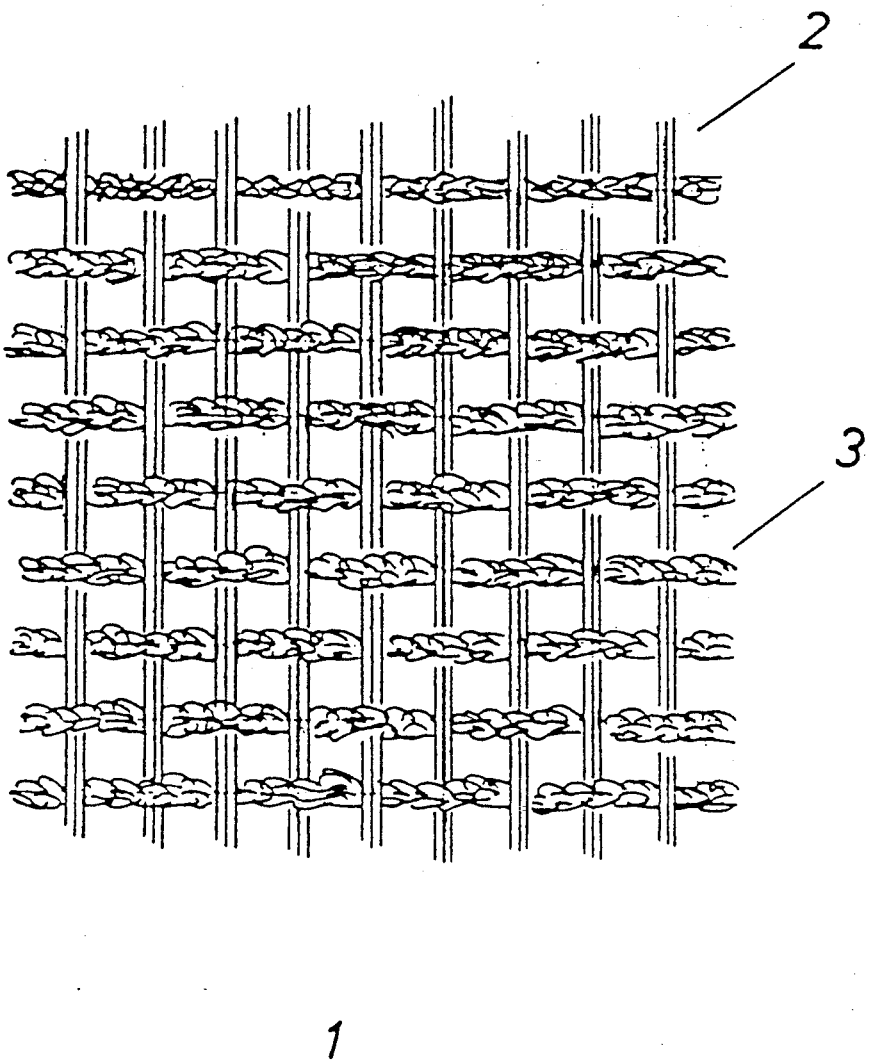

The invention concerns according to its class a woven textile fabric, which is used as a lining in the shirt sector, wherein synthetic fibers are used as the fabric forming warp filaments and as the weft filaments at least partially crimped yarns are used made of synthetic fibers, the finished fabric being coated for combination with other textile materials with a hot sealable adhesive on the basis of copolyesters and/or low pressure polyethylenes in the spot pattern with a spot density of 600 to 1400 spots/inch$^2$.

In the field of the textile industry, for the production of articles of clothing, e.g. outer fabrics are combined by means of so-called linings. These linings can consist of non-woven fabrics, knitted fabrics, woven fabrics or combination products thereof such as knitted non-woven fabrics. Today they are predominantly coated with punctiform, hot sealable adhesive substances, which then, under the influence of pressure and temperature, form a primarily positively locked combination with the outer fabric. The linings have the task of making the outer clothing correctly formed and stabilizing it so that the resilience, wrinkle recovery, stability of form etc. of the outer fabric, correspond to the desires and fashion trends.

In the consideration of the prior art, the point of departure was, inter alia, the Austrian patent application 328 391 of 25th Mar. 1976. Accordingly it is generally known that in the case of a woven lining, fiber material should be used which contains a proportion of synthetic crimped yarn. In the above named application, textured crimped yarns of various polymers are mentioned. But the application is limited to lining materials which are coated with copolyamides in the spot pattern and only contain synthetic yarns in the weft. The warp material consists of natural or regenerated fibers (viscose staple fiber) and the use of the linings produced is limited to materials which are affixed on outer fabrics. Thus the embodiment cited in the above named application describes a lining which consists of a cotton warp and a shrunken double weft of high bulk spun yarn made of polyacryl nitrile fiber. The combination of natural or regenerated fibers in the warp with synthetic fibers in the weft in the form of a woven fabric, which is subsequently coated in a spot pattern with hot sealable adhesive paste made of copolyamides, must therefore be included in the well-known prior art.

Thus for example there has also been for decades past, the possibility in the case of very fine fabrics such as are used in shirts of achieving a stabilization of the material in the collar, cuff, button panel or pocket regions by means of linings. The state of development in the case of shirt linings is cotton fabrics which exist on the market in a multiplicity of types, in order to be able to adapt to the constant variations of the shirt manufacturer with consideration of the problem. The free valences in the possibilities of modification are to be found in the construction of the fabric, i.e. variation of the warp and/or weft density, the filament strength, filament number, fiber rotation etc. or in the type of finish of the fabric and including various coating technologies for the adhesives, which are to be applied in punctiform manner. All these efforts are lastly also employed to create a harmony between the shirt and the lining, which leads indeed to the fulfillment at all times of its function by the lining, but does not lead optically to an adverse effect. Regrettably, this criterion is frequently not attained. The pure fixing between the shirt lining and the shirt material, as a rule, is not problematical. But when the shirt has to be washed after a period of wear, after boiling, often unattractive manifestations appear. These may include:

detachments between the shirt material and the lining
formation of bubbles
an orange shading
formation of creases
high shrinkage etc.

Often these complaints lead to loss of reputation in the market, connected with turnover losses and thus to economic drawbacks. Apart from the purely optical problems, particularly shrinkage leads to reductions in collar size, so that such a shirt can no longer be expediently closed at the collar.

Therefore the invention is based on the problem of designing a lining of this class such that it no longer has the disadvantages described above.

To solve this problem, the invention teaches that a woven textile fabric should be used which contains a synthetic yarn in the warped and weft filaments, wherein the weft yarn consists at least partially of a crimped yarn and the total fabric is then coated in punctiform manner with a hot sealable adhesive, on the basis of copolyesters and/or low pressure polyethylene having a dot density of 600 to 1400 dots/inch$^2$. A shirt lining in accordance with the invention is of such surprising quality that it must be regarded as a leap forward in innovation. It is characterized by the following features:

high elasticity; and therefore uniform shrink behaviour of the shirt material
very low warp and weft shrinkage
four processing steps are omitted by comparison with the cotton lining which was previously used, when producing the inventive lining.

The unusually low shrinkage and the high elasticity should be stressed as especially advantageous. Precisely these two properties create an unexpected harmony between the lining and the outer fabric, which is expressed after washing in an impeccable image of the goods
with no constriction of the collar.

Further expedient embodiments of the invention are characterized in the subclaims.

Thus it has been found to be especially advantageous when a textured polyester is used as the weft yarn. Polyester is known as a shrink-resistant and laundry and/or cleaning resistant material in the textile field.

Moreover the use of high bulk yarns of polyacrylnitrile in the yarn constitutes a positive embodiment of the invention. Thus for example the voluminous nature of the lining which is produced by the high bulk yarns is esteemed.

The application also considers the use of a polyester yarn in the warp direction. For this purpose polyester yarns of multifilaments and staple fibers are suitable.

A further development of the invention consists of a fabric which in the warp and/or weft yarn has filaments of different polymer composition. This means that e.g. the warp yarn can consist of a different polymer from that of the weft yarn.

In addition there is also the possibility of using a multifilament warp yarn or weft yarn made of a mixture of different polymer individual filaments. Thus the warp yarn may consist of polymer and the weft yarn of a polymer mixture. But polymer yarns having a small proportion of natural fibers can also be used.

The invention also provides for the use of various color tones in the weft and warp yarn. This does not exclude the possibility that the warp yarn per se and/or the weft yarn may consist of a color combination caused by differently colored individual filaments.

Furthermore it is claimed that a finished fabric in accordance with the invention can be dyed. In the case of some and particularly colored shirt outer fabrics it is advisable to adapt the lining to the color tone of the shirt, to avoid the lining being seen through the outer fabric.

The invention also takes into consideration a lining in the shirt sector which is marked in the warp and/or weft yarn. As the marking, an optical brightener can be used as well as an X-ray contrast agent and metal fibers etc. The object of the markings is to provide an identification with respect to quality, fit, conductivity etc. In the production of the lining this may be of interest in the quality control sector or in later possible applications. The marking can concern in the warp and weft yarn individual filaments as well as individual fibers and fiber ranges.

The invention also provides for the production of the lining as a fire-resistant article. There is the possibility that either the fibers themselves or the finished fabric can be made flame-proof or flame-proofing can be attempted by the prior selection of suitable materials.

The trend in the market is towards an increase in the use of finer mono-filaments, which are below 1 dtex in fiber fineness. These materials are all classified as the so-called microfibers. Fabrics made from microfibers have a very pliable behaviour. Fabrics made of microfibers which correspond to the claims of the invention, are also usable advantageously as linings in the shirt sector.

Naturally the coating with a hot sealable adhesive also has a decisive influence on the quality of the shirt lining. Punctiform coatings have been shown to be especially advantageous in the linings sector. Various processes have been established for the application of punctiform coatings, so that all the known processes can also be used for the coating of the woven shirt linings in accordance with the invention. This includes the process of powder spot coating, paste spot coating or paste spot coating with subsequent application of diffused powder before the thermal treatment. The last named process, which is also called the double-spot process is described in more detail in German patent application P 22 14 236.

A very important advantage of the new fully synthetic shirt lining is that the woven untreated material requires no special treatment steps, but can be coated directly with a hot sealable adhesive paste. For example, in contrast to cotton lining, the bleaching process, the shrink stabilization treatments with reactive synthetic resins and the sanforiztion processes are omitted.

After the application of the coating spots which are based on hot sealable adhesive pastes, a calender process can still be carried out. This calender process flattens out the existing spots and also expands the surface of the shirt lining covered with adhesive paste. A powder spot coating with low pressure polyethylene powder or polyester powder, which are applied by the powder spot coating process, has been found to be a necessary embodiment of the invention. To ensure a smooth appearance of the outside of the shirt material, a spot raster coating of 600 to 1400 spots/inch$^2$ is carried out. The subsequent calendering has also been found to improve the product. The penetration through the shirt material is thereby avoided.

Depending on the purpose and quality of the shirt material, an application weight for the synthetic fabric lining in the case of an adhesive paste applied on one side has been found to be suitable of between 13 and 30 g/m$^2$ and preferably between 15 and 24 g/m$^2$ to ensure the necessary washing stability of the cleaning composition.

The invention also provides for the coating of a lining not only unilaterally, but bilaterally. Today this is not yet a standard method, but it can expand the range of uses for special requirements.

On the whole, the inventive shirt lining constitutes a progressive step which was not to be expected after years of testing with other linings. The harmony created by the inventive design of the lining between the shirt outer fabric and the lining leads to such a great improvement in the product that a large range of economic applications is to be expected. Moreover inevitably because of the saving in the number of process steps during the production of the inventive lining there are substantial advantages by comparison with the cotton linings formerly used. These advantages are found not only in a reduction of the processing steps, but also in the omission of chemically polluted waste water and waste vapours. This environmental aspect should constitute a further incentive for the increased use of the inventive shirt lining.

The invention will now be explained in more detail by an especially advantageous embodiment. The inventive lining was designed for use with shirts.

Such a lining, however, can also be used with similar applications.

FIG. 1 shows a schematic embodiment of the inventive shirt lining. The fabric 1 consists of multifilament polyester warp filaments 2 and weft filaments of crimped yarn 3. The fabric is coated on the side away from the observer with a hot-sealable adhesive in the spot raster and is then calendered.

EXAMPLE

A shirt lining coated with hot sealable adhesive of the following type:

| | |
|---|---|
| Texture: | linen weave |
| warp yarn: | polyester 78/24 dtex, optically brightened |
| weft yarn: | polyester 76/24 dtex, textured and optically brightened |
| finished weft density: | 200-205 per 10 cm |
| warp yarn density: | 361 on a width of 10 cm |
| coating: | powder spot of low pressure polyethylene powder |
| subsequent treatment of the coating: | calendering |
| application weight | 16-20 g/m$^2$ |
| shrinkage: | the lining is fixed against itself, after boiling at 90° C., shrinkage $<1.5\%$ in warp and weft |
| total weight: | approximately 80 g/m$^2$. |

The linings were fixed against each other at about 145° C. joint sealing temperature for about 15 seconds and at a pressure of 2000 p/cm$^2$.

We claim:

1. A woven textile fabric used as a lining in the shirt sector, wherein synthetic fibers are used as fabric forming warp filaments, and as the weft filaments at least partially crimped yarns of synthetic fibers are used, and wherein the synthetic fabric is coated with hot sealable adhesive on the basis of copolyesters and/or low pressure polyethylene in the spot raster with a spot density of 600 to 1400 spots/inch$^2$.

2. A lining in the shirt sector as in claim 1, wherein the warp yarn consists of polyester.

3. A lining in the shirt sector as in claim 1, wherein the warp and/or weft yarn consists of filaments of different polymers.

4. A lining in the shirt sector as in claim 1, wherein the individual mono-filament in the warp and/or weft yarn has less than 1 dtex.

5. A lining in the shirt sector as in claim 1, wherein said woven textile fabric is unfinished.

6. A lining in the shirt sector as in claim 1, wherein it is coated in spot raster pattern on both sides.

7. A lining in the shirt sector as in claim 1, wherein the warp and/or weft yarn consists of a mixture of different polymeric individual filaments.

8. A lining in the shirt sector as in claim 1, wherein the amount of coating applied on one side is in the range of from 13 to 30 g/m$^2$.

9. A lining in the shirt sector as in claim 8, wherein the amount of coating is from 15 to 24 g/m$^2$.

10. A shirt which includes the lining of claim 1.

* * * * *